US005979536A

United States Patent [19]

Iwamoto et al.

[11] Patent Number: 5,979,536

[45] Date of Patent: Nov. 9, 1999

[54] DIE CASTING MACHINE WITH PRESSURE SUPERVISORY SYSTEM SUPERVISING CAVITY PRESSURE, AND DIE THEREFOR

[75] Inventors: Norihiro Iwamoto; Shinobu Kodama; Noboru Fujiyoshi, all of Kanagawa, Japan

[73] Assignee: Toshiba Kikai Kabushiki Kaisha, Tokyo, Japan

[21] Appl. No.: 08/897,276

[22] Filed: Jul. 21, 1997

[30] Foreign Application Priority Data

Jul. 22, 1996 [JP] Japan ..... 8-192432

[51] Int. Cl.[6] ..... B22D 17/32

[52] U.S. Cl. ..... 164/155.3; 164/154.8; 164/312

[58] Field of Search ..... 164/457, 65, 61, 164/151, 155.3, 154.8, 113, 312, 158

[56] References Cited

U.S. PATENT DOCUMENTS 4,577,670 3/1986 Moore ..... 164/155.3

5,511,605 4/1996 Iwamoto ..... 164/155.3

5,782,287 7/1998 Iwamoto et al. ..... 164/155.3

FOREIGN PATENT DOCUMENTS 2-59163 2/1990 Japan ..... 164/158

*Primary Examiner*—Kuang Y. Lin

*Attorney, Agent, or Firm*—Thomas, Kayden, Horstemeyer & Risley

[57] ABSTRACT

A dynamic variation of a cavity pressure (P, Vac) in a die cavity (17) defined between a stationary die (3) and a movable die (7) is supervised during an injection of molten metal (M) by a pressure supervisory system (27, 29, 43, 45, 53, 75, 83, 95) that includes a pressure detection path (27,37) communicating with the die cavity, a pressure sensor (73) for detecting the cavity pressure through the pressure detection path and a processor (75) for processing detection data of the cavity pressure, and the stationary die (3) is formed with a pressure detection port (27) that constitutes part of the pressure detection path.

14 Claims, 9 Drawing Sheets

DIE CASTING MACHINE WITH PRESSURE SUPERVISORY SYSTEM SUPERVISING CAVITY PRESSURE, AND DIE THEREFOR

BACKGROUND OF THE INVENTION

1. Field of the Invention

The present invention generally relates to a die casting machine and a die therefor, and particularly, it relates to a die casting machine with a pressure supervisory system for supervising a set of pressures including a pressure of a body of atmosphere in a die cavity (hereafter sometimes "cavity pressure") to produce a casting with an upgraded quality, and a die therefor.

2. Description of Relevant Art

The die casting machine employs a set of two or more dies as casting molds therefor that have a cavity defined therebetween when locked or clamped together.

Gases in the die cavity should be vented, when injecting molten metal. For a casting with a stable quality, it is important to surely vent the gases. The die cavity has one or more gas vents, which may occasionally fail to sufficiently vent gases containing e.g. gasified die lubricant, because of a body of lubricant accumulated or deformed with heat or by intensified locking forces, or the like.

An insufficient venting of such gases raises the cavity pressure. While a body of gases as atmosphere left in the die cavity has an increased pressure, a required pressure for casting a body of injected molten metal has a fraction thereof absorbed by the residual atmosphere so that the molten metal has an insufficient pressure acting thereon, occasionally receiving additional adverse influences such as by parts of the atmosphere entangled in the molten metal, resulting in an increased ratio of non-conforming products with a problem in quality.

Conventionally, there has been detected a flow rate of gases discharged from a gas vent, to externally check a state of atmosphere in a die cavity, when molten metal is injected thereto. A flow sensor is installed outside dies to measure a flow rate of gas streams in a secondary passage making use an effect of an ejector. A long service life of the flow sensor is thus expectable.

However, such the conventional measurement is subject to a reduced accuracy due such as to a blocking of a diffuser due to a flushing and an influence of dust in atmosphere around the sensor.

Further, as a die cavity has a number of gas vents, it is necessary for an effective quality control of castings to provide an identical number of gas flow meters for measuring gas flow rates of the gas vents, thus needing an impractical complicated system.

SUMMARY OF THE INVENTION

The present invention has been achieved with such points in view.

It therefore is an object of the present invention to provide a die casting machine with a pressure supervisory system for supervising a set of pressures including an externally detected cavity pressure in a practical manner with an increased accuracy, and a die therefor.

To achieve the object, a first aspect of the invention provides a die casting machine (1) comprising a first die (3), a second die (7) movable relative to the first die, a locking system (C, 5, 9, R) for locking the first and second dies to each other to have a die cavity (17) defined therebetween, an injection system (11, 13, 15) for injecting a body of molten metal (M) under a variable injection pressure to the die cavity, and a pressure supervisory system (27, 29, 43, 45, 53, 75, 83, 95) for supervising a set of pressures associated with a die casting operation of the die casting machine to produce a casting (19), the set of pressures including a cavity pressure (P, Vac) in the die cavity, the pressure supervisory system comprising a pressure detection path (27,37) communicating with the die cavity, first pressure detection means (29, 47) for detecting the cavity pressure through the pressure detection path, and a processor (75) for processing detection data of the cavity pressure to supervise the cavity pressure.

According to the first aspect, a cavity pressure is transmitted outside dies through a pressure detection path, permitting a practical external direct detection of actual pressure with an increased accuracy.

According to a second aspect of the invention, as it depends from the first aspect, the pressure supervisory system further comprises purge means (49) for purging the pressure detection path (27,37) to prevent a blocking therein.

According to the second aspect, a pressure detection path as well as a die cavity can be purged to remove foreign matter before detecting a cavity pressure.

According to a third aspect of the invention, as it depends from the first aspect, the pressure supervisory system further comprises second pressure detection means (48, 53) for detecting a pressure difference across the pressure detection path (27,37), and the processor (75) processes detection data of the pressure difference to confirm no blocking in the pressure detection path.

According to the third aspect, a pressure supervisory system checks a pressure detection path, not simply for a blocking, but to confirm no blocking before entering a detection of a cavity pressure. If a blocking is found, the pressure detection path may be purged, and re-checked to confirm no blocking.

Accordingly, a processor in the pressure supervisory system is permitted to store, access and process updated data on a fluid resistance and an associated pressure drop that the pressure detection path has thereacross when transmitting the cavity pressure to be detected. A detected cavity pressure may favorably be corrected by using updated data.

According to a fourth aspect of the invention, as it depends from the first aspect, the pressure supervisory system further comprises an air vent path (31, 33, 35) communicating at a first end thereof with the die cavity and exposed at a second end **(31*a*, 33*a*, 35*a*) thereof to an atmospheric pressure, and opening control means (83) cooperative with the processor (75)** for controlling an opening area of the air vent path at the second end thereof to set the cavity pressure to a desirable pressure.

According to the fourth aspect, a pressure drop across a gas vent is controllable to thereby control a cavity pressure for an arbitrary shot, as well as a pattern of a dynamic variation of the cavity pressure. As an exact cavity pressure is detected and supervised, there is permitted an accurate pressure control for an ensured casting quality.

According to a fifth aspect of the invention, as it depends from the first aspect, the pressure supervisory system further comprises a vacuum transmission path (97) communicating at a first end thereof with the die cavity and connected at a second end **(97*a*) thereof to a vacuum source, and vacuum control means (95) provided at the second end of the vacuum transmission path and cooperative with the processor (75)** for controlling the cavity pressure to a desirable vacuum pressure.

According to the fifth aspect, a cavity pressure as well as a pattern of a dynamic variation thereof is controllable in terms of a vacuum pressure of a body of atmosphere in a die cavity, as the die casting machine is a vacuum suction type. As an exact cavity pressure is detected and supervised, there is permitted an accurate vacuum pressure control for an ensured casting quality.

According to a sixth aspect of the invention, as it depends from the first aspect, the first pressure detection means (47) detects a dynamic variation of the cavity pressure (P, Vac) when the body of molten metal (M) is injected into the die cavity (17).

According to the sixth aspect, a pressure supervisory system is permitted to detect and supervise a dynamic variation of cavity pressure developing during a molten metal injection, including a pattern analysis to be fed back for a pressure control for a subsequent shot.

According to a seventh aspect of the invention, as it depends from the sixth aspect, the die casting machine (1) further comprises pressure control means (15, 83, 95) for controlling the cavity pressure (P, Vac), the injection operation comprises a first shot cycle executable for producing said casting (19), a second shot cycle executable after the first shot cycle for producing another said casting (19), and a third shot cycle excutable after the second shot cycle, and the pressure supervisory system (45, 75) is operable for detecting the dynamic variation of the cavity pressure in the first shot cycle, detecting the dynamic variation of the cavity pressure in the second shot cycle, receiving a data on a comparison between said casting and said another casting, and governing the pressure control means in dependence on the received data so that the third shot cycle has the cavity pressure exhibiting a preferable one of the dynamic variations of the first and the second shot cycle.

According to the seventh aspect, a die casting machine is permitted to automatically learn and execute a better pattern of a dynamic variation of cavity pressure that otherwise should be physically studied by an individual operator through a training over many years under attended advices of a skilled worker.

According to an eighth aspect of the invention, as it depends from the first aspect, the injection system comprises an injection cylinder (11) connected to the die cavity (17) and formed with an opening **(11*a*) for introducing the body of molten metal (M) into the injection cylinder, and a plunger (15) fitted in the injection cylinder and adapted to slide therealong in the injection operation so that a piston part (15*a*) thereof travels from an original position to a stroke end position, and the first pressure detection means (47) detects the cavity pressure (P, Vac) when the piston part (15*a*) of the plunger is located between the opening (11*a*)** of the plunger cylinder and the stroke end position.

According to the eighth aspect, a pressure supervisory system is permitted to supervise a dynamic variation a cavity pressure exhibits when molten metal is injected in a die cavity.

According to a ninth aspect of the invention, as it depends from the first aspect, the pressure detection path (27, 37) comprises a groove (27) formed in a parting surface **(3*a*) of the first die (3) for communication with the die cavity (17), an external opening (37*c*) provided outside the first die, and a communication port (37)** for interconnecting the groove and the external opening with each other.

According to the ninth aspect, a die cavity is connected outside a first die by a communication path consisting of a groove, a communication port and an external opening, permitting an external direct detection of a cavity pressure.

Further, to achieve the object described, a tenth aspect of the invention provides a die (3, 7) for a die casting machine (1), the die comprising a die body (3, 7) having a surface region shaped to define a side of a die cavity (17), and a pressure detection port (27) formed in the die body for transmitting therethrough a pressure (P, Vac) of a body of atmosphere in the die cavity to an external pressure sensor (73).

According to the tenth aspect, a cavity pressure can be directly detected by an external pressure sensor.

According to an eleventh aspect of the invention, as it depends from the tenth aspect, the die further comprises a molten metal runner (25) formed in the die body for letting an injected body of molten metal (M) into the die cavity (17).

According to a twelfth aspect of the invention, as it depends from the eleventh aspect, the die further comprises an air vent path (31, 33, 35) formed in the die body for venting the body of atmosphere therethrough, as the injected body of molten metal enters the die cavity.

According to a thirteenth aspect of the invention, as it depends from the tenth aspect, the die further comprises a detection support block (29) embedded in the die body for supporting the pressure sensor to detect the pressure, the detection support block comprising a block body, and a communication port (37) formed through the block body for interconnecting the pressure detection port (27) with an external line (43, 65) connected to the pressure sensor.

According to the thirteenth aspect, a detection support block embedded in a die body supports a pressure detection of an external pressure sensor, saving a space.

According to a fourteenth aspect of the invention, as it depends from the thirteenth aspect, the detection support block (29) further comprises a cooling path **(41*a*, 41*b*)** for cooling the block body.

According to the fourteenth aspect, an associated fraction of an injected body of molten metal is chilled, before it escapes through a pressure detection port.

According to a fifteenth aspect of the invention, as it depends from the thirteenth aspect, the detection support block (29) further comprises a seal member (39) for sealing an interconnection region between the pressure detection port (27) and the communication port (37).

According to the fifteenth aspect, a seal member prevents an unfavorable leakage.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
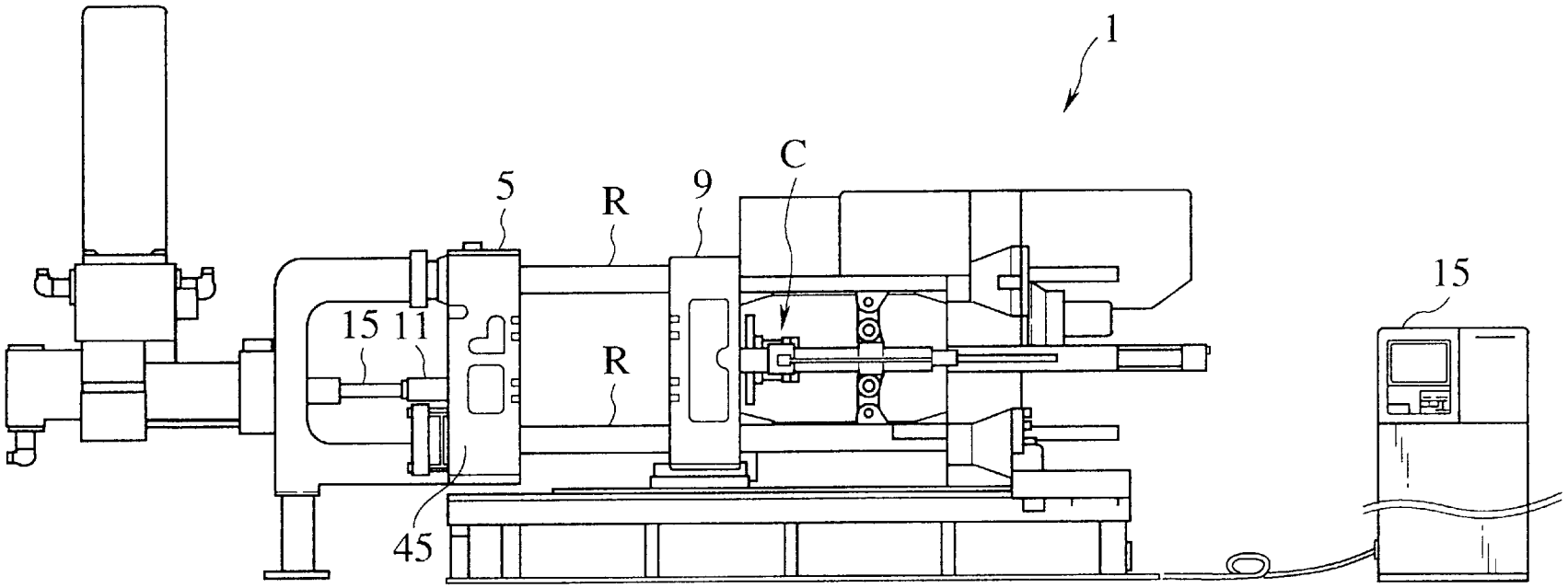
FIG. 1 is a side view of a die casting machine according to an embodiment of the invention.

There will be detailed below the preferred embodiments of the present invention with reference to the accompanying drawings. Like members are designated by like reference characters.

FIG. 1 shows a die casting machine 1 according to an embodiment of the invention.

As illustrated in FIG. 1, the die casting machine 1 comprises: a stationary platen 5 supported by a sound frame equipped with cooling water circuitry; a movable platen 9 slidably mounted on guide rails on a base frame and movable relative to the stationary platen 5; a plurality of tie bars R for supporting die locking forces; a clamp unit C with a die closing cylinder and a toggle link mechanism, an ejector cylinder and hydraulic circuitry; a molten metal injection system including an unshown ladling unit, a shot sleeve 11, an injection cylinder with a plunger 15 fitted in the sleeve 11, an intensifier, and pneumatic circuitry associated with an air unit 45 having a control board; and a machine control system substantially concentrated at a control panel 15.

The machine control system includes a later-described pressure supervisory system for supervising (i.e. detecting, monitoring, sampling, storing, processing such as for an estimation and/or a decision, and/or controlling) a set of pressures (e.g. hydraulic pressures, pneumatic pressures, cooling water pressures, various cavity pressures including a vacuum pressure, reference pressures and pressure data such as on a dynamic variation of cavity pressure and vent opening setting) associated with a respective die casting operation of the die casting machine 1 to produce a casting with a conforming high quality.

Figure 2:
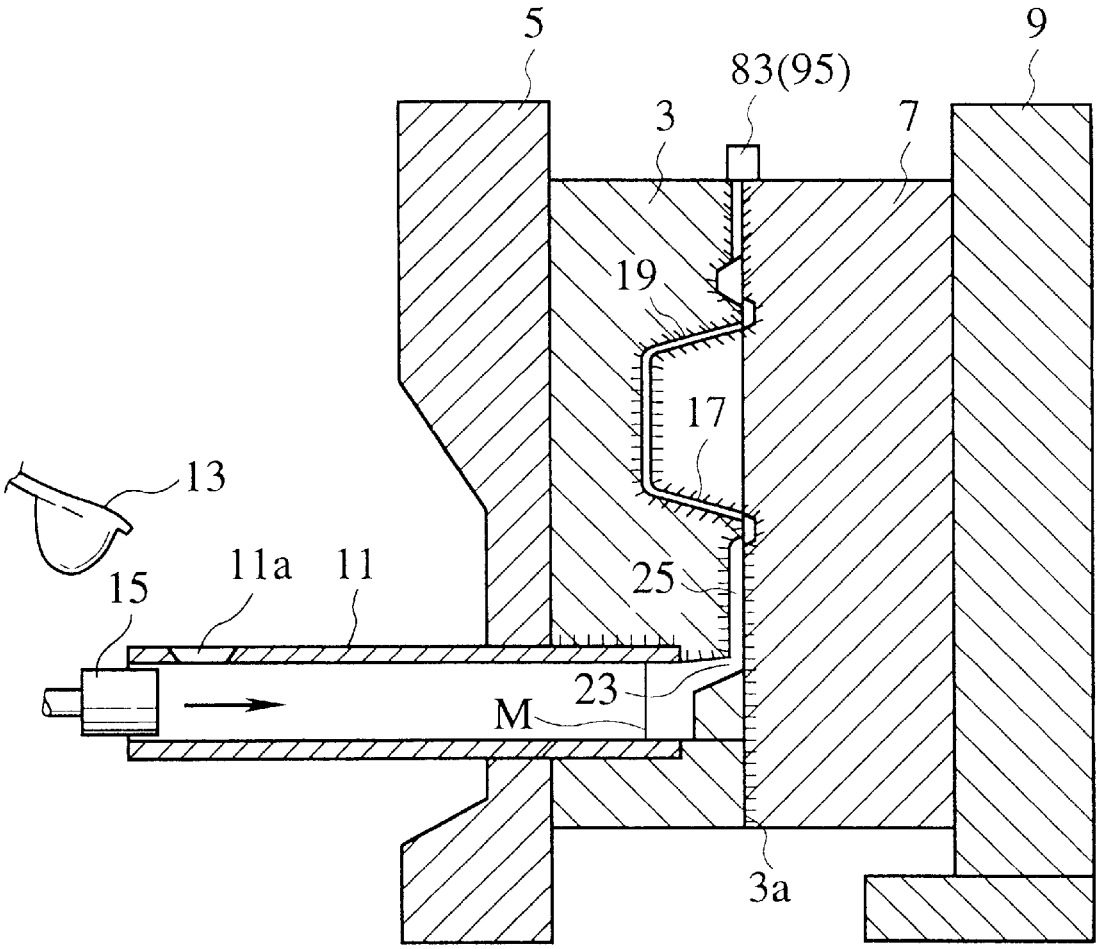
FIG. 2 is a longitudinal section of an essential part including a pair of dies of the die casting machine of FIG. 1.

FIG. 2 shows an essential part of the die casting machine 1.

The stationary platen 5 has a stationary die 3 fixed thereto, and the movable platen 9 has a movable die 7 fixed thereto in opposition to the stationary die 3. As this platen 9 is moved by the clamp unit C toward that platen 5, the movable die 7 likewise moves relative to the stationary die 3 until they close to be locked to each other as in FIG. 2.

The stationary die 3 is formed with a sprue 23 and a runner 25 in accordance with a designed gating system. The dies 3 and 7 have their parting surfaces 3*a* shaped in designed configurations. As the dies 3, 7 are locked together, the parting surfaces 3*a* have a die cavity 17 defined therebetween. The cavity 17 communicates via a lower gate with the runner 25 and via medium and upper gates with overflow wells and air vents.

The shot sleeve 11 is provided through the stationary platen 5 and inserted in the stationary die 3 so that an inner chamber of the sleeve 11 communicates at a distal end thereof with the sprue 23. The sleeve 11 has an opening 11*a* formed through an upper circumferential wall at a base end thereof. A ladle 13 automatically appears above the opening 11*a* and pours a body of molten metal M through the opening 11*a* into the sleeve chamber As the plunger 15 is actuated to advance at a variable controlled speed toward a designed stroke end, the molten metal M is injected through the sprue 23 and the runner 25 into the die cavity 17, with a varying pushing force of the plunger 15 that is supported by an intensified pressure (and by a suctioning vacuum pressure in the cavity 17 in the case of a vacuum type die casting machine), but opposed soon by a progressively rising pressure of gases, if any in the cavity 17, and reaction forces from part of molten metal M occupying the cavity 17 as well as chilled or overflowing fractions of molten metal M, while associated pressures are all favorably supervised by the pressure supervisory system so that a casting 19 has a good quality in every concerned respect for artisan.

Figure 8:
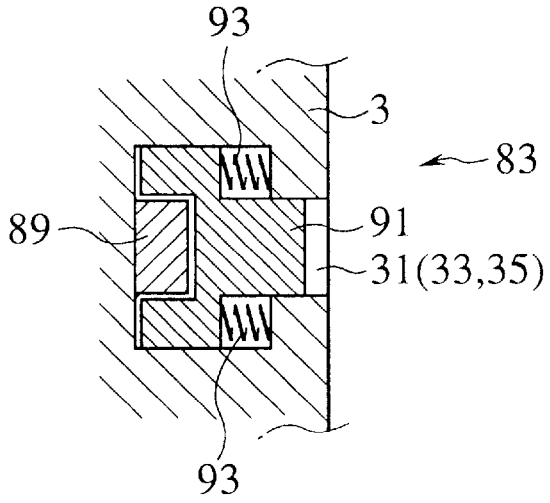
FIG. 8 is a section along line VIII—VIII of FIG. 7.
Figure 9:
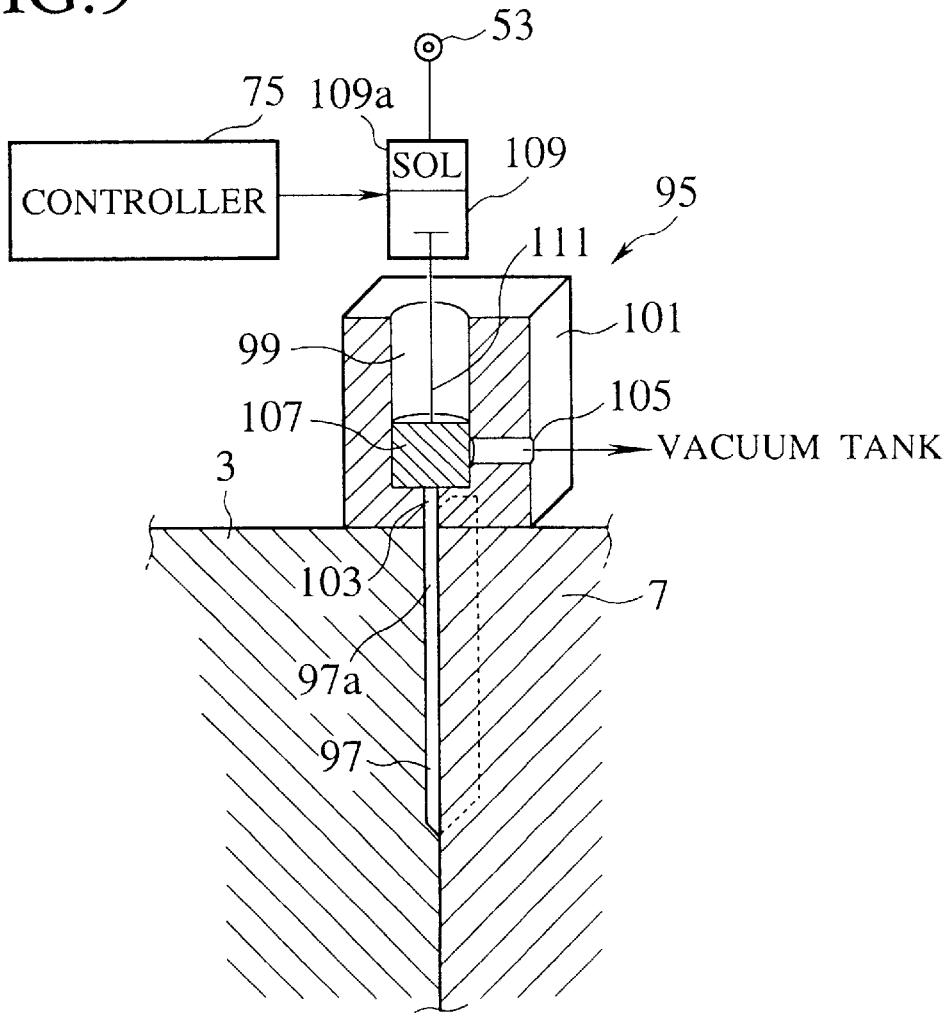
FIG. 9 is a section of a vacuum control mechanism of the dies of FIG. 2.

In FIG. 2, designated by reference character 83 is a later-described vent opening control system (FIGS. 7-8), and 95 is a later-described vacuum control system (FIG. 9).

Figure 3:
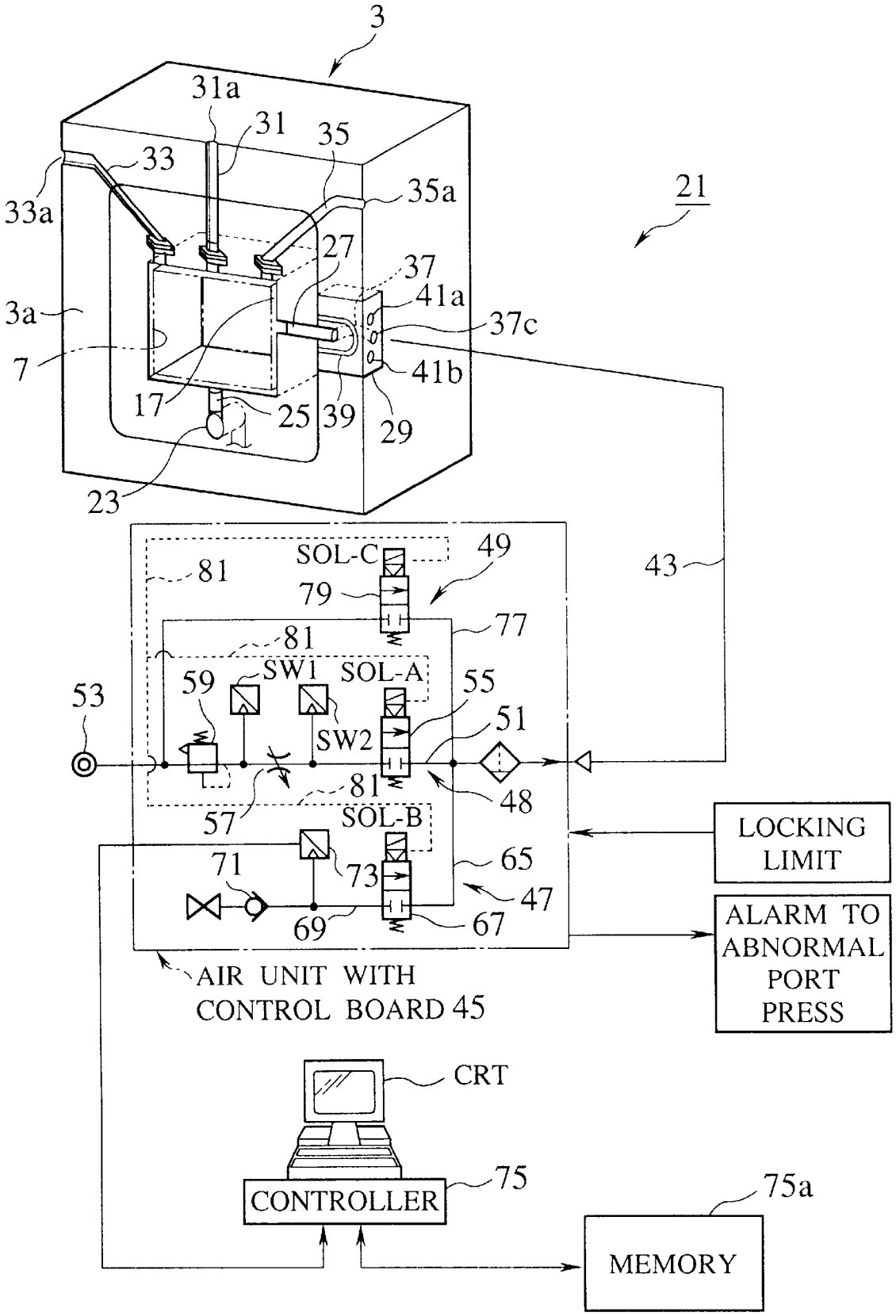
FIG. 3 is a combination of a perspective view of a stationary die and a block diagram of a pressure supervisory system of the die casting machine of FIG. 1.

FIG. 3 is a combination of a perspective view of the stationary die 3 and a block diagram of the pressure supervisory system including a circuit diagram of the air unit 45.

In FIG. 3, designated by reference character 21 is an entirety of the pressure supervisory system. The pressure supervisory system 21 comprises: a pressure detection path composed of a horizontal groove 27 formed in a vertically central region of a right inner part of the parting surface 3*a* of the stationary die 3 for communication with the die cavity 17, an external opening 37*c* formed outside of a later-described detection support block 29 (FIGS. 4–6) as a rectangular parallelpiped body embedded in a vertically central region of a peripheral part of the parting surface 3*a* of the die 3, and a communication port 37 formed through the block 29 for interconnecting the groove 27 and the external opening 37*c* with each other; a pressure transmission line 43 (e.g. hose) connected at one end to the external opening 37*c* of the pressure detection path; the air unit 45 with control board having a filtering connection port connected to another end of the pressure transmission line 43; a pneumatic power source as an air source 53 connected to the air unit 45; the vent opening control system 83 (FIGS. 7-8) or the vacuum control system 95 (FIG. 9); and part of the control panel 15 (FIG. 1, FIGS. 10–12) including a controller 75 electrically connected to the air unit 45 and composed of a CPU (central processing unit) and peripheral equipment connected thereto, such as a CRT (cathode ray tube) or LCD (liquid crystal display), a I/O (input/output) interface, a touch panel and/or key board, and a memory 75*a* having a ROM (read only memory) for storing control programs and a RAM (random access memory) for storing associated data in an updatable manner. The stored data contain data on a fluid resistance of the pressure transmission line 43 and pressure drops thereacross under various conditions of use, as well as those of the pressure detection path.

The stationary die 3 comprises: a die body having the parting surface 3*a* with an inner region shaped to define a side of the cavity 17; the groove 27 as a pressure detection port formed in the die body, with a depth of 0.05 mm or near, for transmitting a pressure of a body of atmosphere in the cavity 17 via the external opening 37*c* and the pressure transmission line 43 to the air unit 45; the molten metal runner 25 formed in the die body and cooperating with the sprue 23 and a gate for letting an injected body of molten metal M into the cavity 17; a total of three air vent paths 31, 33 and 35 formed in the die body for venting gases of the cavity 17 to avoid having undue excessive pressures acting on molten metal M injected into the cavity 17, the air vent paths having their inner gate ends communicating with the cavity 17 and their external ends 31*a*, 33*a* and 35*a* communicating with the atmospheric air; and the detection support block 29 embedded in the die body for supporting the air unit 45 to detect a vacuum or gas pressure in the cavity 17 when injecting molten metal M, as well as a pressure difference between the cavity 17 and the air unit when compressed air is supplied from the air unit via the pressure transmission line 43 and the pressure detection path to the cavity 17 for a purge or for confirmation of no blocking.

The air unit 45 comprises: a compressed air circuit 49 connectable to the pressure transmission line 43 for purging the pressure detection path 27 and/or 37 after lubricant is sprayed as well as after the dies 3 and 7 are closed or when necessary such as for eliminating a detected or potential blocking; a differential pressure detection circuit 48 connectable to the pressure transmission line 43 for detecting a pressure difference between the air unit 45 and the cavity 17 to support the controller 75 for checking an established communication through the pressure detection path 27+37 and the pressure transmission line 43 with no blocking, before molten metal M is poured in the shot sleeve 11; and a cavity pressure detection circuit 47 connectable to the pressure transmission line 43 for detecting a varying cavity pressure when molten metal M is injected into the cavity 17, as well as for checking a controlled vacuum pressure or gas pressure in the cavity 17.

The pressure transmission line 43 is connected to one end of a piping 51 of which another end is connected to the air source 53. The differential pressure detection circuit 48 includes a changeover valve 55 with a solenoid SOL-A, a variable throttle valve 57 and a relief valve 59 serially installed on the piping 51 in this order from a downstream end, and has a first pressure switch SW1 connected to the piping 51 between the relief valve 59 and the throttle valve 57 and a second pressure switch SW2 as a pressure detector connected to the piping 51 between the throttle valve 57 and the changeover valve 55.

The piping 51 is connected on the way to one end of a piping 65 of which another end is connected to one end of a changeover valve 67 with a solenoid SOL-B, which valve 67 is connected at another end to one end of a piping 69 of which another end is connected to a check valve 71. This piping 69 is connected on the way to a pressure sensor 73 as a pressure detector connected to the controller 75. The cavity pressure detection circuit 47 comprises the changeover valve 67, the check valve 71 and the pressure sensor 73.

The piping 51 is further connected on the way to one end of a piping 77 having installed thereon a changeover valve 79 with a solenoid SOL-C, constituting the compressed air circuit 49, which piping 77 is connected at another end again to the piping 51 between the relief valve 59 and the air source 53.

The solenoids SOL-A, SOL-B and SOL-C provided for the changeover valves 55, 67 and 79, respectively, are inter-connected thereamong by a control signal cable 81.

Figure 4:
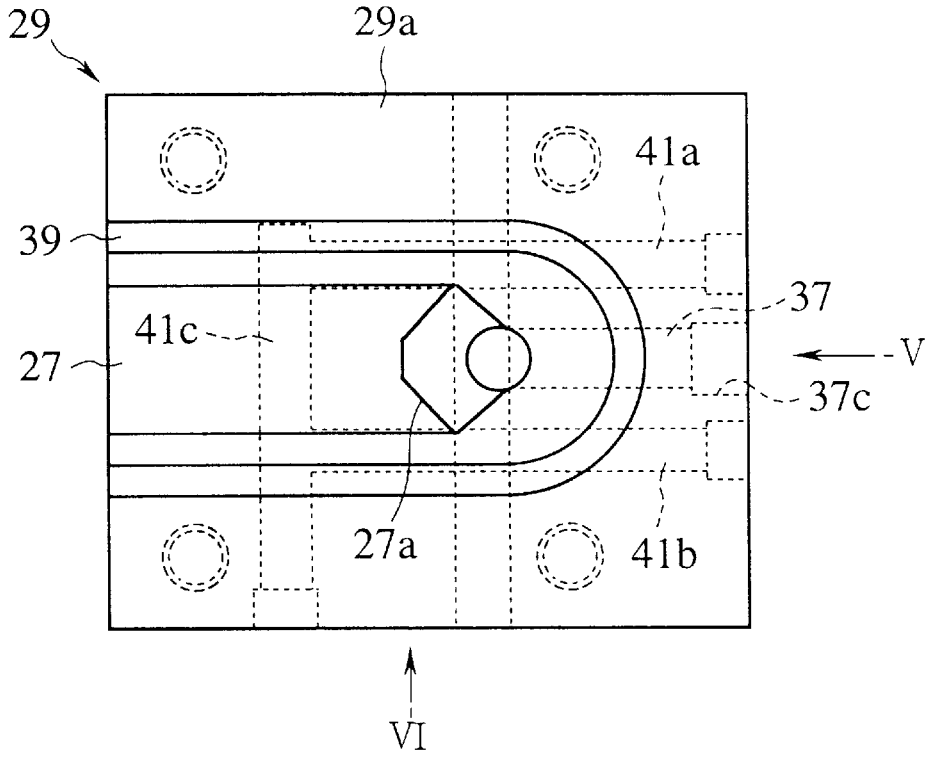
FIG. 4 is a front view of a detection support block embedded in the stationary die of FIG. 3.
Figure 5:
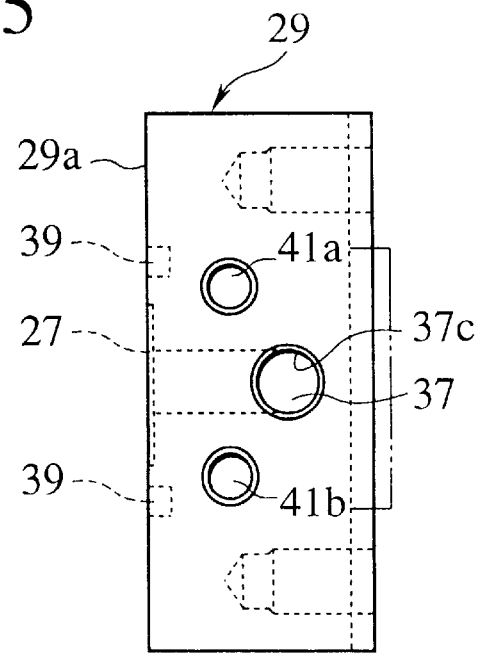
FIG. 5 is a side view along an arrow V of FIG. 4.
Figure 6:
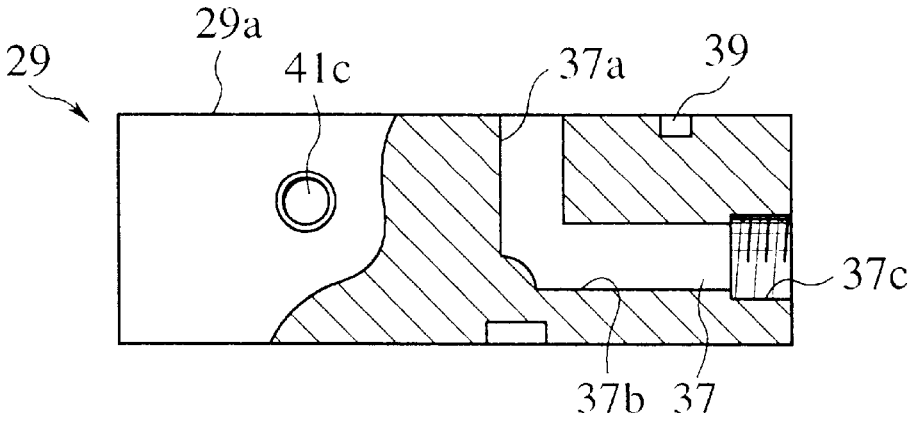
FIG. 6 is a bottom view along an arrow VI of FIG. 4.

FIG. 4 is a front view of the detection support block 29, and FIGS. 5 and 6 are a side view and a partially cut bottom view of the same, respectively.

The detection support block 29 comprises: a connection part of the groove 27 formed in a vertical inside surface 29*a* of the rectangular parallelepiped block body; the communication port 37 formed through the block body for interconnecting the connection part of groove 27 with the pressure transmission line 43 of which one end is screwed into the external opening 37*c* that is a threaded end of the port 37; a number of cooling paths formed through the block for a solidification of molten metal M, including a pair of upper and lower horizontal cooling paths 41*a* and 41*b* and a vertical cooling path 41*c* extending in a perpendicular direction thereto at a depthwise spaced location; and a seal member 39 such as a so-called O-ring for enclosing to seal an interconnection region between the pressure detection port 27 and the communication port 37. The communication port 37 has an inwardly extending path 37*a* communicating at an outer end thereof with a recessed end region 27*a* of the groove 27, and a horizontally outwardly extending path 37*b* communicating at one end thereof with an inner end of that path 37*a* and at another end thereof with the external opening 37*c*.

Figure 7:
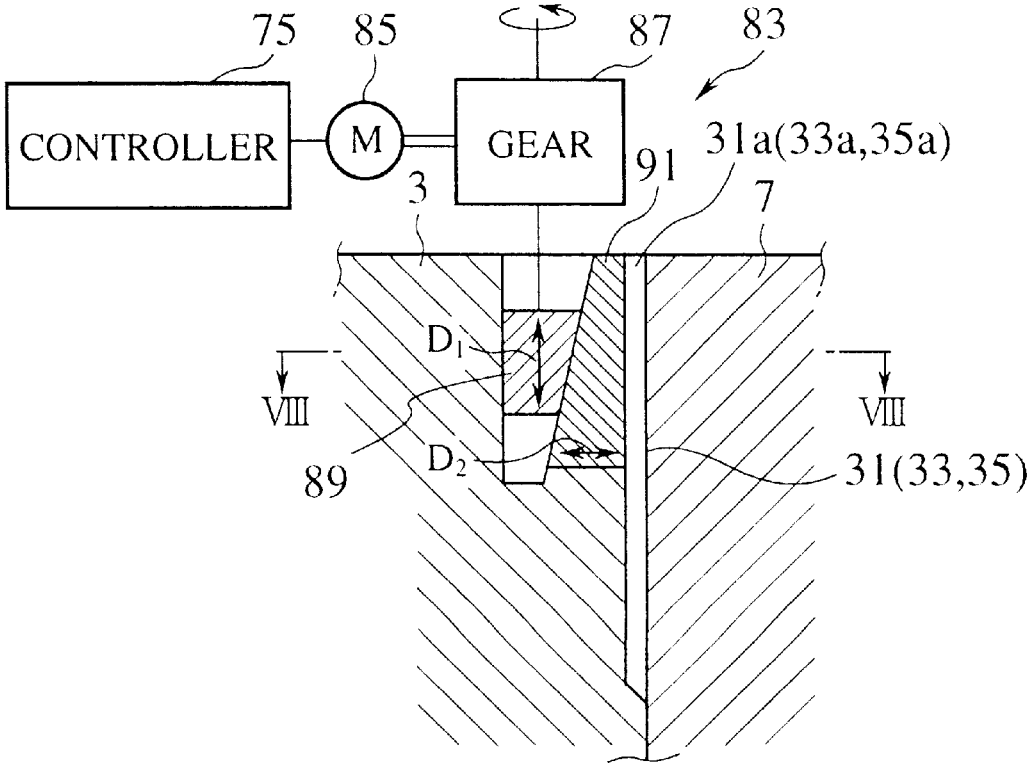
FIG. 7 is a section of an opening control mechanism of the dies of FIG. 2.

FIG. 7 shows the vent opening control system 83 provided at the end opening part 31*a* of the air vent 31, which may be the air vent 33 or 35. FIG. 8 is a section along line VIII—VIII of FIG. 7.

The vent opening control system 83 comprises: a drive motor 85 controlled by the controller 75; a transmission gear 87 for converting a rotation of the drive motor 85 into a vertical displacement D1; a wedge member 89 vertically slidable to be shifted by the displacement D1; an opening regulating member 91 horizontally slidable to be shifted by a horizontal displacement D2 in dependence on the vertical displacement D1 of the wedge member 89; and a plurality of spring members 93 for normally resiliently urging the opening regulating member 91 so that the end opening part 31*a* of air vent 31 has an increased opening.

As the controller 75 controls the drive motor 85 to rotate, the transmission gear 87 converts the rotation into a vertical displacement D1, thereby shifting the wedge member 89, causing the opening regulating member 91 to be moved by a corresponding horizontal displacement D2, thereby regulating an opening area of the air vent 31. A regulated opening is responsible for controlling a dynamic variation of the cavity pressure to a desirable pattern.

FIG. 9 shows the vacuum control system 95, which is employed in a vacuum die casting machine to control a vacuum pressure in a die cavity 17.

The vacuum control system 95 comprises: a vacuum block 101 attached to stationary and movable dies 3 and 7 for hermetically sealing a vacuum runner 97 as a vacuum pressure transmission path communicating with the die cavity 17; a vacuum connection line 105 for interconnecting an unshown vacuum tank with a cylindrical inner vacuum chamber 99 of the vacuum block 101 that communicates with an end opening part 97*a* of the vacuum runner 97; and a pneumatic cylinder 109 of which a cylinder chamber is connected via a solenoid 109*a* to the air source 53 and a piston member is interlinked with a vacuum valve 107 vertically slidably fitted in the vacuum chamber 99. The solenoid 109*a* is controlled by the controller 75 for operating the cylinder 109.

As the piston member vertically moves with a pneumatic pressure supplied from the air source 53, the vacuum valve 107 is vertically moved, regulating an associated opening to keep part of the vacuum chamber thereunder at a vacuum pressure lower than preset, thereby suctioning gases from the vacuum runner 97 so that the cavity 17 has a controlled vacuum pressure.

Figure 10:
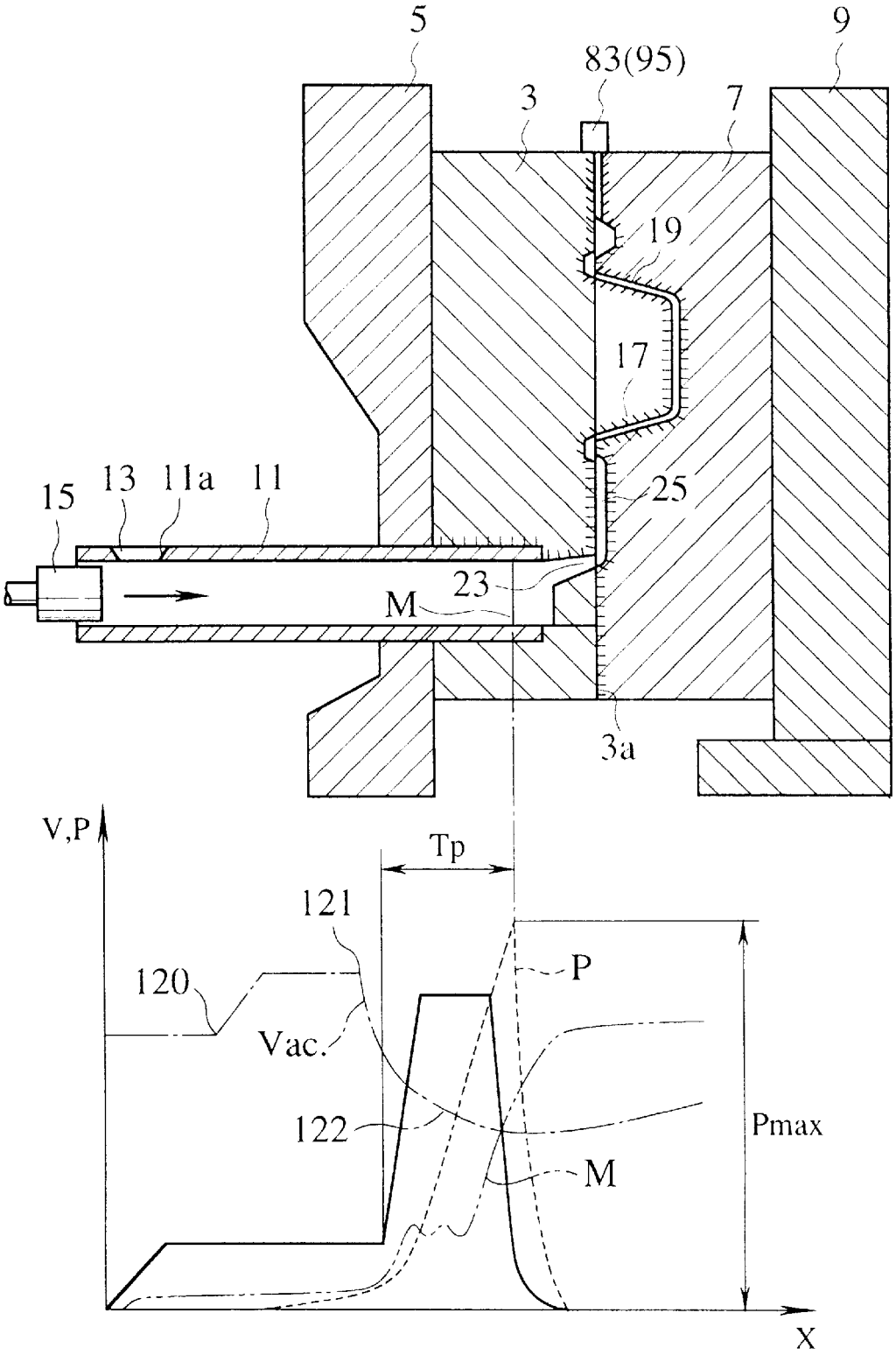
FIG. 10 is a sectional view of a partially modified essential part of the die casting machine of FIG. 1, including a pair of dies with parting surfaces shaped in a mirror image with respect to the dies of FIG. 2, combined with a graph of associated characteristic curves.
Figure 11:
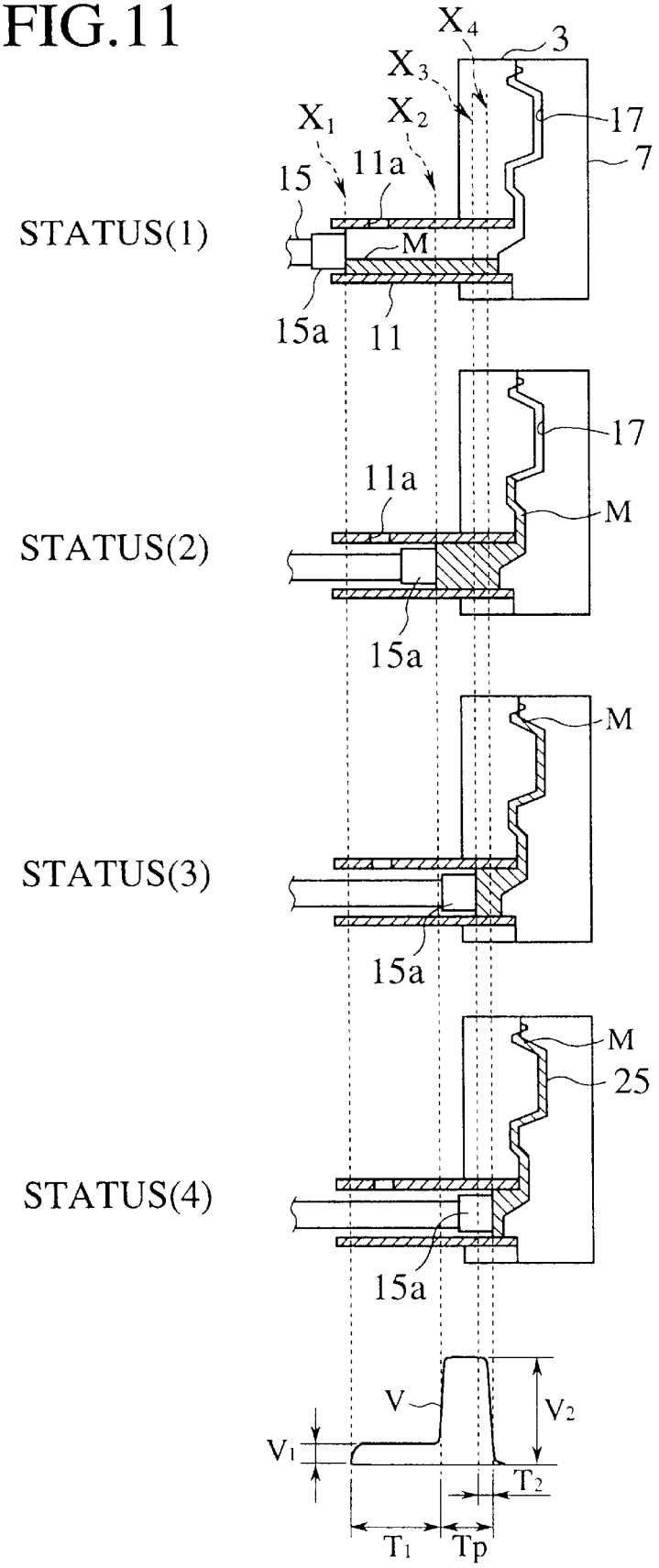
FIG. 11 is an illustration of a series of varying status of a body of molten metal, as it is injected by a plunger into a die cavity between the dies of FIG. 10.

FIG. 10 shows dies 3 and 7 with their parting surfaces 3*a* shaped in a mirror image with respect to the dies of FIG. 2, and a displayed graph of characteristic curves based on automatic detections in a casting operation covering an injection period in which a tip as a piston part of a plunger 15 travels from a left original position to a right stroke end. FIG. 11 shows a series of varying status (1) to (4) of a body of molten metal M, as it is injected by the plunger tip into a die cavity 17 defined between the dies of FIG. 10.

In the graph of FIG. 10, a slid line curve represents a speed V of the plunger 15 when injecting the molten metal M into the cavity 17, and a broken line curve represents a cavity pressure P at an associated plunger tip position X, as the pressure P is detected by a combination of the pressure sensor 73 and the controller 75 for producing a casting 19 of a high quality.

As the high quality is aimed, the plunger 15 travels at a low speed along an initial distance, before it suddenly ascends to a high speed to be kept for a peak point Tp until it stops, arriving at the stroke end. Along therewith, the cavity pressure P increases initially gradually, and soon progressively, reaching a maximum value Pmax at a plunger tip position vicinal to the stroke end, before it slopes down.

Such a dynamic variation of cavity pressure P is measured all the way, continuously or intermittently, and analysed to visualize a pattern on the CRT or LCD of controller 75 and sampled as a set of data to be stored in the memory 75*a*, for a comparison or calculation of deviation to permit an evaluation based on an observation of the produced casting 19.

The vent opening control system 83 or vacuum control system 95 is concurrently operated for regulating openings of air vents 31, 33 and/or 35 or controlling a suction opening of the vacuum runner 97, while collecting associated operational data to be stored in the memory 75*a* so that they can be accessed and updated by an identification number of the pattern of the dynamic variation of cavity pressure P.

In the graph of FIG. 10, designated at reference character M is a reference curve representing a typical pressure of molten metal M, and Vac is a vacuum pressure curve. The vacuum pressure Vac rises at a point 120, where a molten metal pouring opening 11*a* of a shot sleeve 11 is closed by the plunger 15, and starts gradually falling at a point 121, as the vacuum valve 107 opens with a delay, until it has a lowest value at a point 122, as the vacuum valve 107 closes with a delay to complete an injection.

As shown in FIG. 11, the injection of molten metal M is controlled so as to experience four status (1) to (4).

The status (1) corresponds to a low speed interval T1 during which the plunger tip 15*a* travels substantially at a low speed V1 from a low speed injection start position X1 to a high speed injection start position X2.

The status (2) corresponds to a high speed interval Tp without intensification, during which the plunger tip 15*a* travels substantially at a high speed V2 from the high speed injection start position X2 to an intensified injection start position X3.

The status (3) corresponds to a remaining period T2 of the high speed interval Tp, in which an intensified injection is performed at a decreasing speed and during which the plunger tip 15*a* travels from the intensified injection start position X3 to an injection completion position X4.

The status (4) corresponds to a finish of the molten metal injection.

Figure 12:
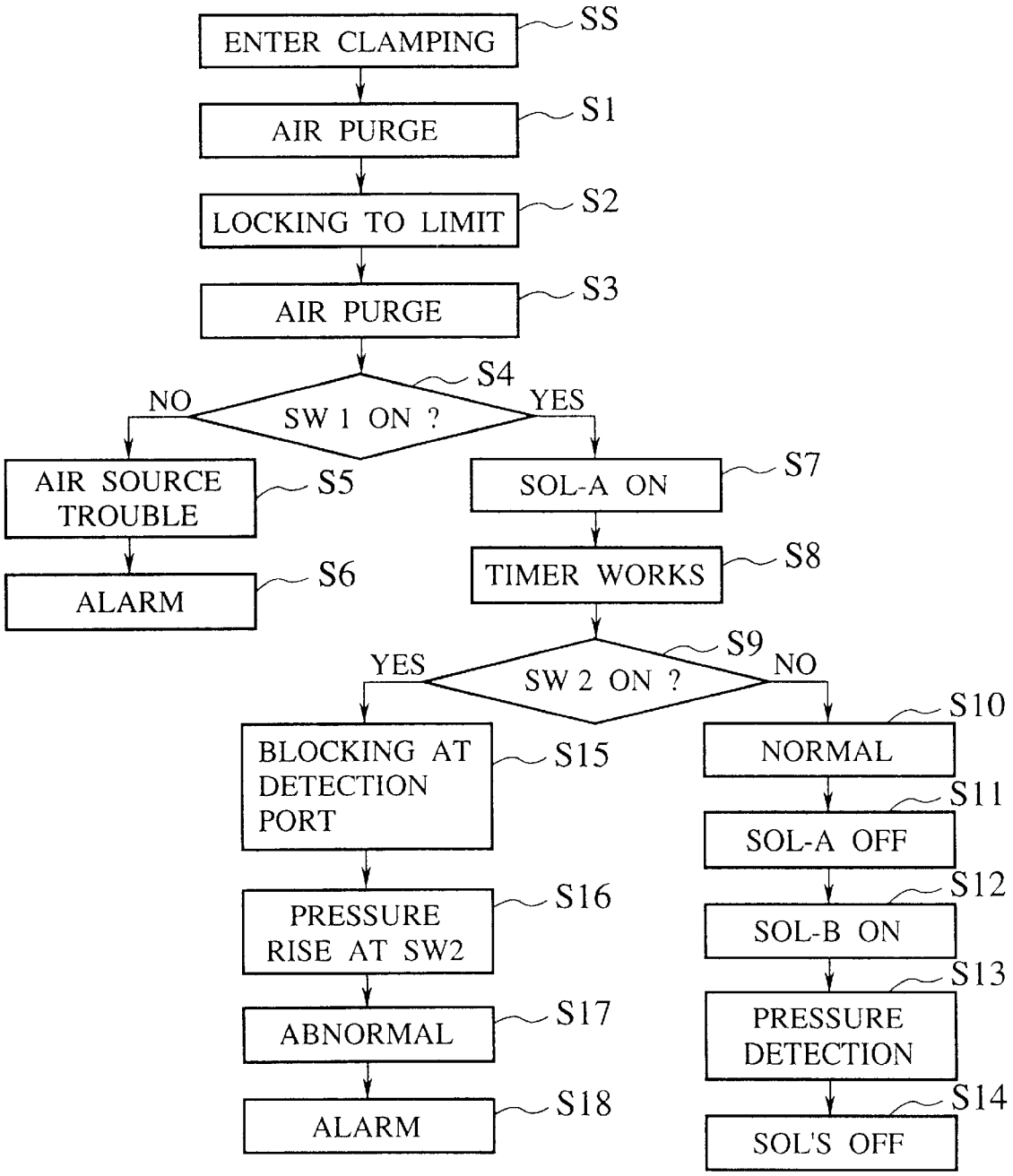
FIG. 12 is a flow chart of actions associated with a die casting operation of the die casting machine of FIG. 1.

FIG. 12 shows a flow of control actions associated with a die casting operation of the die casting machine of FIG. 1, as it has the dies of FIG. 2 or those of FIG. 10. In this control flow, the confirmation of no blocking is effected by checking a state of the second pressure switch SW2.

At a step SS, the clamp unit C enters a die clamp operation, as the changeover valves 55, 67 and 79 are set to their off positions (as in FIG. 3) with the solenoids SOL-A, SOL-B and SOL-C off.

At a step S1, the solenoid SOL-C of changeover valve 79 is turned on, so that compressed air is conducted from the air source 53 via the pipings 77 and 51, the pressure transmission line 43 and the communication port 37 to the groove 27, purging the groove 27 to prevent a blocking, over a predetermined period. Then, the solenoid SOL-C is turned off.

At a step S2, the movable die 7 is locked to the stationary 3 to an end.

At a step S3, the solenoid SOL-C of changeover valve 79 is again turned on, so that compressed air from the air source 53 is conducted via the pipings 77 and 51, the pressure transmission line 43 and the communication port 37 to the groove 27, purging the groove 27 for a predetermined period, before turning the solenoid SOL-C off.

At a step S4, compressed air is discharged from the air source 53 into the piping 51, checking a pressure in the piping 51 to be a predetermined level.

If the first pressure switch SW1 is then off, the flow goes via a step 5 for a decision such that a supplied pressure from the air source 53 should be short, to a step 6 for outputting an alarm.

If the first pressure switch SW1 is on with a required pressure detected, the flow goes to a step S7 for turning on the solenoid SOL-A of the changeover valve 55. A detection timer starts to provide a time lag for covering a pressure reduction due to a fraction of air escaping through the molten metal pouring opening 11*a*.

At a preset timing, e.g. after a lapse of 50 sec., the detection timer works so that at a step S8 the compressed air from the air source 53 is supplied via the pipings 51, the pressure transmission line 43 and the communication port 37 to the groove 27 and is discharged inside the cavity 17.

At a step S9, the second pressure switch SW2 is checked if it is turned on.

If the second pressure switch SW2 is then off, the flow goes to a step 10 for a decision such that the groove 27 should be normal without blocking.

Accordingly, the pressure detection circuit 47 starts detecting a cavity pressure. In other words, the solenoid SOL-A of changeover 55 is turned off at a step S11, and the solenoid SOL-B of changeover valve 67 is turned on at a concurrent step S12. Gases in the die cavity 17 is thus conducted via the groove 27, communication port 37, pressure transmission line 43, piping 51 and piping 65 to the piping 69, where they act on the pressure sensor 73 so that a cavity pressure is detected at a step S13. Then, at a step S14, the solenoid SOL-B is turned off.

If the second pressure switch SW2 is on, the flow goes via a step S15 for a decision such that a blocking should have been developed in the groove 27 and a step S16 where the second pressure switch SW2 has detected an increased pressure, to a step S17 for detecting an abnormal state and a step S18 for outputting an alarm.

Such the checking routine is repeated every shot cycle for an ensured accurate detection of cavity pressure.

If a detected cavity pressure is deviated, the vent opening control system 83 or the vacuum control system 95 is operated to achieve a desired capacity, before pouring molten metal M into the sleeve 11 for a shot to be started thereafter.

It will be seen that a detected pressure should be a representative pressure employable for control, but not always be needed to be a true pressure, although the pressure supervisory system 21 could determine this whenever required.

The control system of the die casting machine 1 is adaptive for a variety of casting operations. The pressure supervisory system is responsible therefor. A favorable injection operation may comprise: a first shot cycle executable for producing a first casting 19; a second shot cycle executable after the first shot cycle for producing a second casting 19; and a third shot cycle excutable after the second shot cycle, as the pressure supervisory system is operable for detecting a dynamic variation of cavity pressure in the first shot cycle, detecting a dynamic variation of cavity pressure in the second shot cycle, receiving a data on a comparison between the first casting 19 and the second casting 19, and governing the vent opening control system 83 or the vacuum pressure control system 93 in dependence on the received data so that the third shot cycle has a cavity pressure exhibiting a preferable one of the dynamic variations of the first and the second shot cycle.

According to the embodiment described, a cavity pressure P or Vac is detected not by measuring a flow rate of gases discharged from a die cavity 17, but by a direct detection using an external pressure sensor 73, permitting a stable detection free of unfavorable influences due to external atmosphere, and a possible accurate control of the cavity pressure allows a high quality casting. As a state of a whole cavity is detected at a single point, an entire system can be scaled down.

Further, a detection support block 29 is incorporated in a die 3, effectively saving a space.

The die 3 or 7 may have a hole formed therethrough for inserting a pin. A cavity pressure may be detected or measured through a groove 27 and the pin hole, using a pressure sensor 73. After injection of molten metal M, the pin hole may be cooled, and the pin may be inserted by pushing with a cylinder or the like for cleaning the groove 27 that may be blocked.

While preferred embodiments of the present invention have been described using specific terms, such description is for illustrative purposes, and it is to be understood that changes and variations may be made without departing from the spirit or scope of the following claims.

What is claimed is:

1. A die casting machine (1) comprising:

a first die (3);

a second die (7) movable relative to the first die;

a locking system (C, 5, 9, R) for locking the first and second dies to each other to have a die cavity (17) defined therebetween;

an injection system (11, 13, 15) for injecting a body of molten metal (M) under a variable injection pressure to the die cavity; and a pressure supervisory system (27, 29, 43, 45, 53, 75, 83, 95) for supervising a set of pressures associated with a die casting operation of the die casting machine to produce a casting (19), the set of pressures including a cavity pressure (P, Vac) in the die cavity, the pressure supervisory system comprising:

a pressure detection path (27, 37) communicating with the die cavity;

first pressure detection means (29, 47) for detecting the cavity pressure through the pressure detection path;

a processor (75) for processing detection data of the cavity pressure to supervise the cavity pressure; and a second pressure detection means (48, 53) for detecting a pressure difference across the pressure detection path (27, 37);

wherein said processor (75) processes detection data of the pressure difference to confirm no blocking in the pressure detection path.

2. A die casting machine according to claim 1, wherein the pressure supervisory system further comprises purge means (49) for purging the pressure detection path (27, 37) to prevent a blocking therein.

3. A die casting machine according to claim 1, wherein the pressure supervisory system further comprises:

an air vent path (31, 33, 35) communicating at a first end thereof with the die cavity and exposed at a second end **(31*a*, 33*a*, 35*a*) thereof to an atmospheric pressure; and opening control means (83) cooperative with the processor (75)** for controlling an opening area of the air vent path at the second end thereof to set the cavity pressure to a desirable pressure.

4. A die casting machine according to claim 1, wherein the pressure supervisory system further comprises:

a vacuum transmission path (97) communicating at a first end thereof with the die cavity and connected at a second end **(97*a*) thereof to a vacuum source; and vacuum control means (95) provided at the second end of the vacuum transmission path and cooperative with the processor (75)** for controlling the cavity pressure to a desirable vacuum pressure.

5. A die casting machine according to claim 1, wherein the first pressure detection means (47) detects a dynamic variation of the cavity pressure (P, Vac) when the body of molten metal (M) is injected into the die cavity (17).

6. A die casting machine according to claim 5, further comprising a pressure control means (15, 83, 95) for controlling the cavity pressure (P, Vac).

7. A die casting machine according to claim 1, wherein the injection system comprises:

an injection cylinder (11) connected to the die cavity (17) and formed with an opening **(11*a*) for introducing the body of molten metal (M) into the infection cylinder; and a plunger (15) fitted in the injection cylinder and adapted to slide therealong in the injection operation so that a piston part (15*a*) thereof travels from an original position to a stroke end position; and the first pressure detection means (47) detects the cavity pressure (P, Vac) when the piston part (15*a*) of the plunger is located between the opening (11*a*)** of the plunger cylinder and the stroke end position.

8. A die casting machine according to claim 1, wherein the pressure detection path (27, 37) comprises:

a groove (27) formed in a parting surface **(3*a*) of the first die (3) for communication with the die cavity (17)**;

an external opening **(37*c*) provided outside the first die; and a communication port (37)** for interconnecting the groove and the external opening with each other.

9. A die (3, 7) for a die casting machine (1), the die comprising:

a die body (3, 7) having a surface region shaped to define a side of a die cavity (17);

a pressure detection port (27) formed in the die body for transmitting therethrough a pressure (P, Vac) of a body of atmosphere in the die cavity to an external pressure sensor (73), said pressure detection port being in fluid communication with an external opening through a pressure detection path;

a first pressure detection means (29, 47) responsive to and for detecting the cavity pressure through the pressure detection path;

a processor (75) responsive to the detection of the cavity pressure for processing detection data of the cavity pressure to supervise the cavity pressure; and a second pressure detection means (48, 53) responsive to and for detecting a pressure difference across the pressure detection path (27, 37);

wherein said processor (75) processes detection data of the pressure difference to confirm no blocking in the pressure detection path.

10. A die according to claim 9, further comprising:

a molten metal runner (25) formed in the die body for letting an injected body of molten metal (M) into the die cavity (17).

11. A die according to claim 10, further comprising:

an air vent path (31, 33, 35) formed in the die body for venting the body of atmosphere therethrough, as the injected body of molten metal enters the die cavity.

12. A die according to claim 9, further comprising:

a detection support block (29) embedded in the die body for supporting the pressure sensor to detect the pressure, the detection support block comprising:

a block body; and a communication port (37) formed through the block body for interconnecting the pressure detection port (27) with an external line (43, 65) connected to the pressure sensor.

13. A die according to claim 12, wherein the detection support block (29) further comprises a cooling path (41*a*, 41*b*) for cooling the block body.

14. A die according to claim 13, wherein the detection support block (29) further comprises a seal member (39) for sealing an interconnection region between the pressure detection port (27) and the communication port (37).

* * * * *